US005609272A

United States Patent [19]

Brass et al.

[11] Patent Number: 5,609,272

[45] Date of Patent: Mar. 11, 1997

[54] ONE TIME USE, NON REUSABLE SPRAYER

[75] Inventors: Richard Brass, Reinbeck, Iowa; Raymond F. Cracauer, Plymouth; Roland Beihl, Invergrove Heights, both of Minn.; Robert C. Hudson, Jr., Northbrook, Ill.

[73] Assignee: H. D. Hudson Manufacturing Company, Chicago, Ill.

[21] Appl. No.: 416,137

[22] Filed: Apr. 4, 1995

[51] Int. Cl.[6] ..... B65D 49/12

[52] U.S. Cl. ..... 222/147; 222/402; 222/465.1; 222/481.5; 222/538

[58] Field of Search ..... 222/147, 401, 222/402, 465.1, 481.5, 494, 538

[56] References Cited

U.S. PATENT DOCUMENTS

| | | | |
|---|---|---|---|
| 715,982 | 12/1902 | Chapin | 222/402 |
| 4,154,369 | 5/1979 | Morane | 222/147 |
| 4,154,401 | 5/1979 | Thompson | 222/402 X |
| 4,635,826 | 1/1987 | Hatakeyama et al. | 222/147 |
| 4,658,975 | 4/1987 | Cone | 222/465.1 X |
| 4,823,445 | 4/1989 | Diener | 222/538 X |
| 4,972,972 | 11/1990 | Goguen | 222/538 X |
| 5,435,469 | 7/1995 | Gager et al. | 222/402 |
| 5,447,258 | 9/1995 | Suzuki | 222/494 |

FOREIGN PATENT DOCUMENTS

| | | | |
|---|---|---|---|
| 975725 | 10/1975 | Canada | 222/402 |

*Primary Examiner*—Joseph Kaufman
*Attorney, Agent, or Firm*—Kane, Dalsimer, Sullivan, Kurucz, Levy, Eisele and Richard, LLP

[57] ABSTRACT

A one time use non reusable sprayer includes a tank having a pump for pressurizing the liquid contents. A connection of the pump to the tank, if severed will result in destruction of the tank and pump to prevent reuse of the sprayer. The sprayer has a hose extending from the tank, a spray control valve and discharge nozzle for directing the spray.

13 Claims, 6 Drawing Sheets

ONE TIME USE, NON REUSABLE SPRAYER

BACKGROUND OF THE INVENTION

Garden and industrial sprayers are normally completely reusable and feature a pressure tank for the liquid solution to be dispensed having a sealable fill opening, an internally mounted piston/cylinder pump for pressurizing the tank interior, an outlet hose, a flow control valve associated with the hose, and an extension rod having a discharge nozzle. The tank is usually filled with the desired chemical in concentrated form and diluted by adding water to arrive at the desired solution for spraying. The chemical concentrate is purchased commercially from the desired source and may be contained in 1 gallon, 5 gallon or higher capacity bottles or containers.

SUMMARY OF THE INVENTION

A principal object of the present invention is to provide a one time use prefilled sprayer that is non reusable and disposable.

Another object is to provide a sprayer of the foregoing type which is sold and purchased as a complete package including a built in pump, outlet hose, spray control valve, rod extension and discharge nozzle.

A further object is to provide a sprayer of the foregoing type that is safe, non refillable, cost effective and relatively easy to manufacture and which possesses a tank similar in appearance to the commercially available bottles or containers for chemical concentrates.

Still another object is to provide a sprayer of the foregoing type that is capable of spraying for at least one minute, will be sufficiently pressurized within 5 to 10 strokes of the pump and will dispense from the spray nozzle from 1 ounce per minute to a nominal rate of 5 ounce per minute at 5 psig.

A still further object is to provide a sprayer of the foregoing type that incorporates a pressure relieve valve that may be activated manually or automatically to vent the head space and prevent over pressurization in the tank.

Other objects and advantages will become apparent from the following detailed description which is to be taken in conjunction with the accompanying drawings.

DETAILED DESCRIPTION

Figure 2:
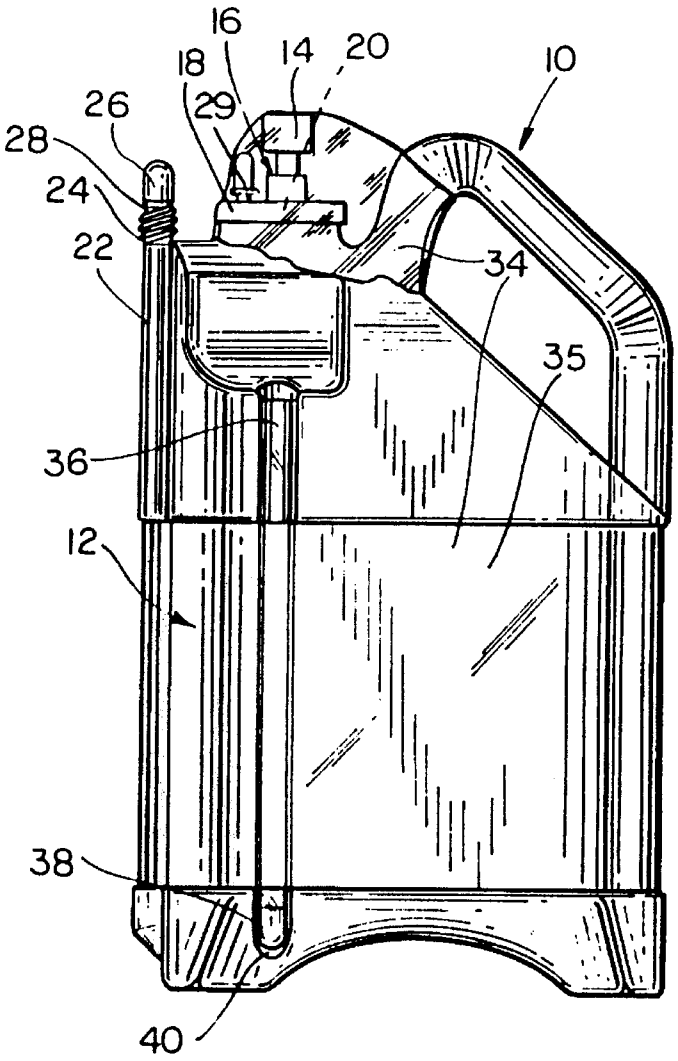
FIG. 2 is a back elevational view of the sprayer package of FIG. 1.
Figure 1:
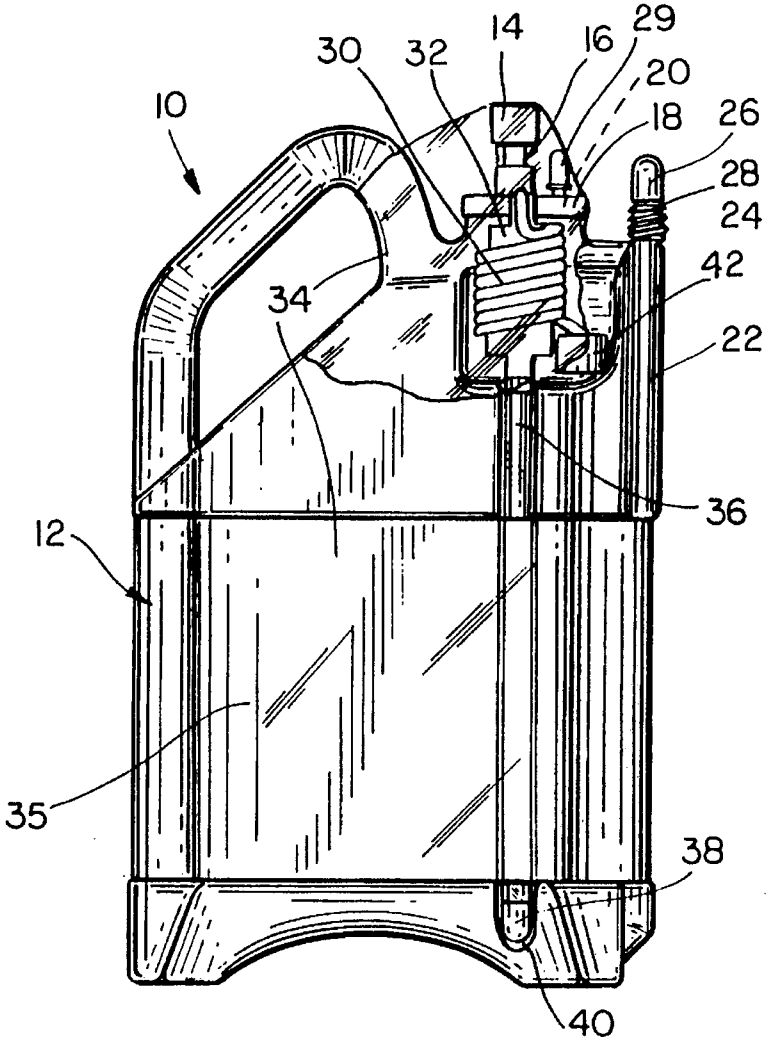
FIG. 1 is a front elevational view of the sprayer package for sale commercially.
Figure 3:
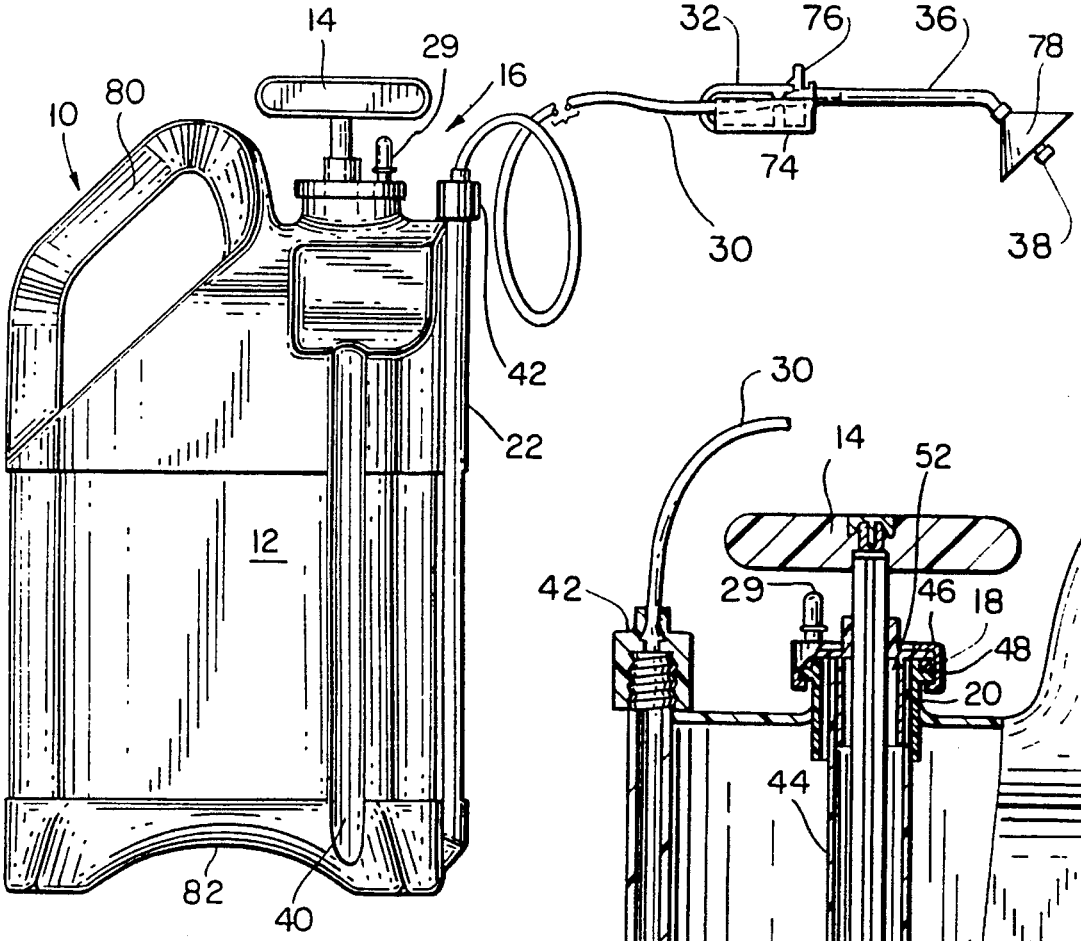
FIG. 3 is a front elevational view of the sprayer of FIGS. 1 and 2 ready for spraying.
Figure 4:
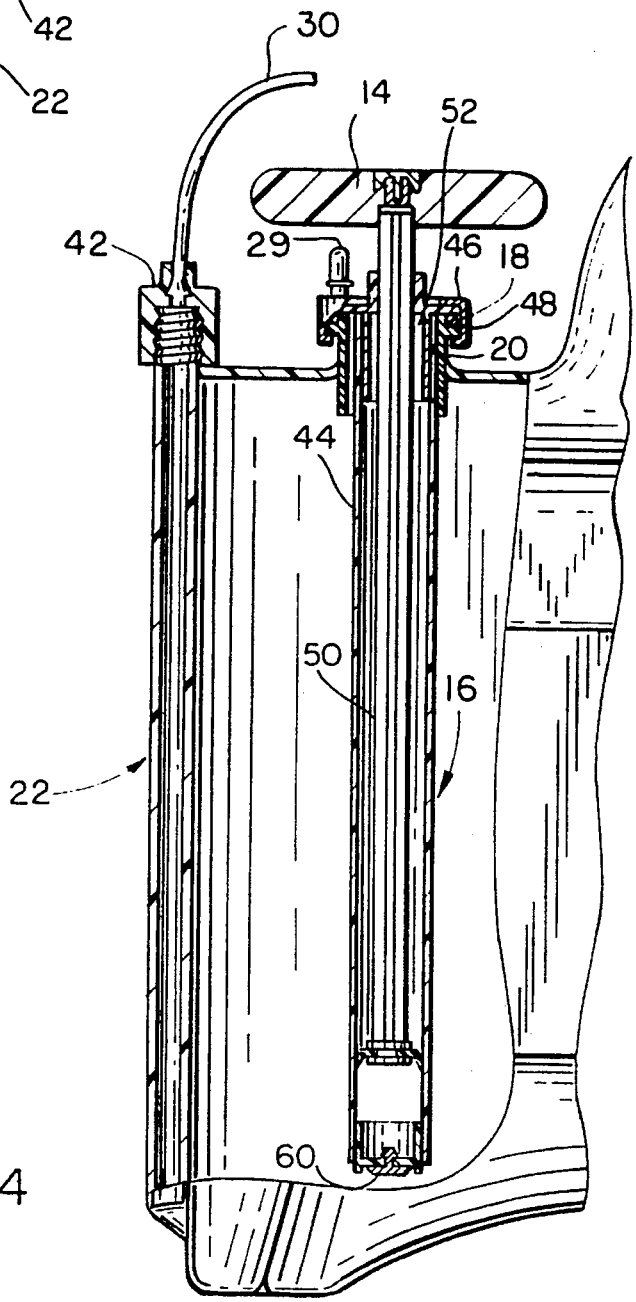
FIG. 4 is an enlarged fragmentary sectional view showing the external supply tube and pump assembly.
Figure 5:
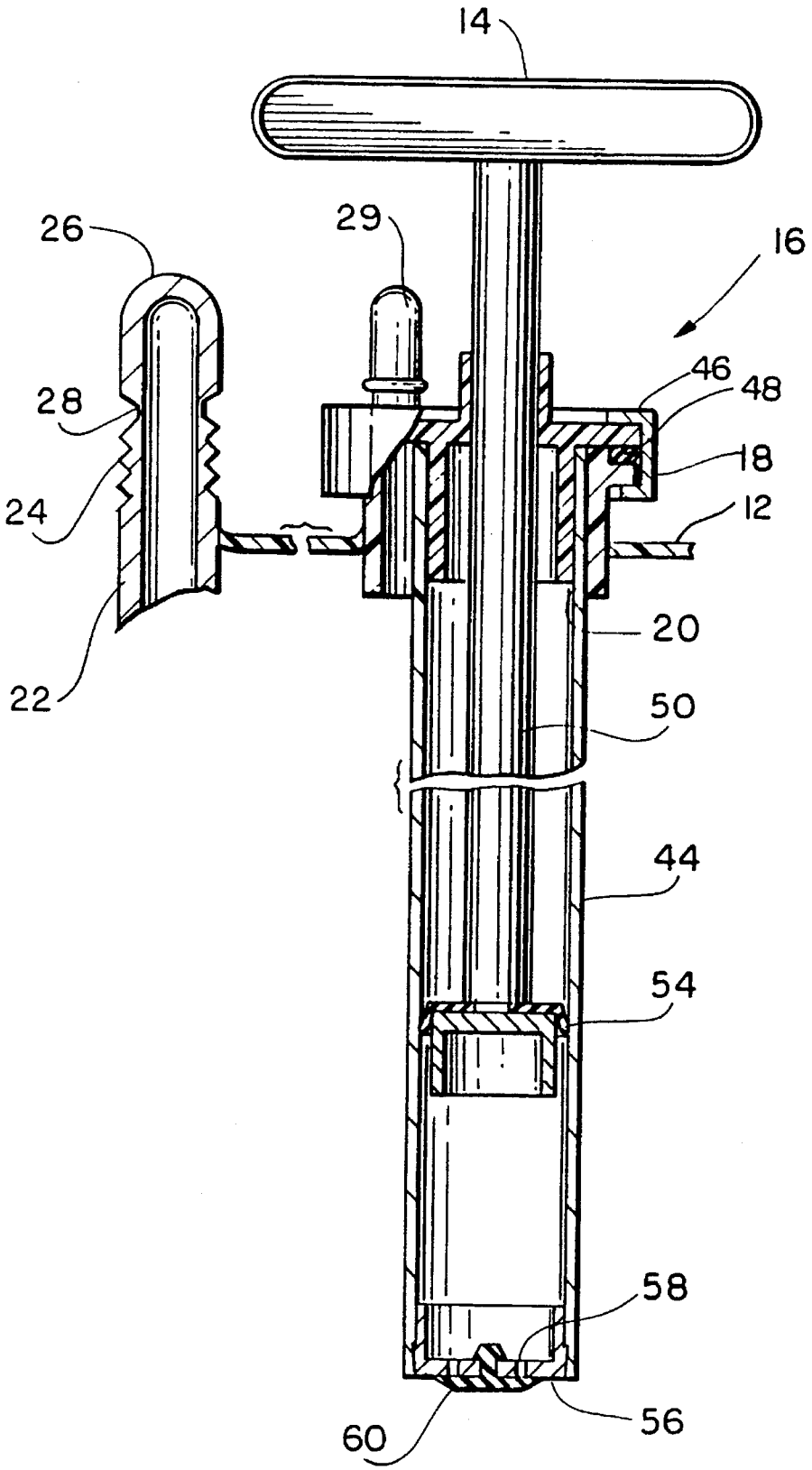
FIG. 5 is a sectional view further enlarged of the pump assembly vent and discharge end of the supply tube sealed and prior to connection to the proximal end of the hose.
Figure 6:
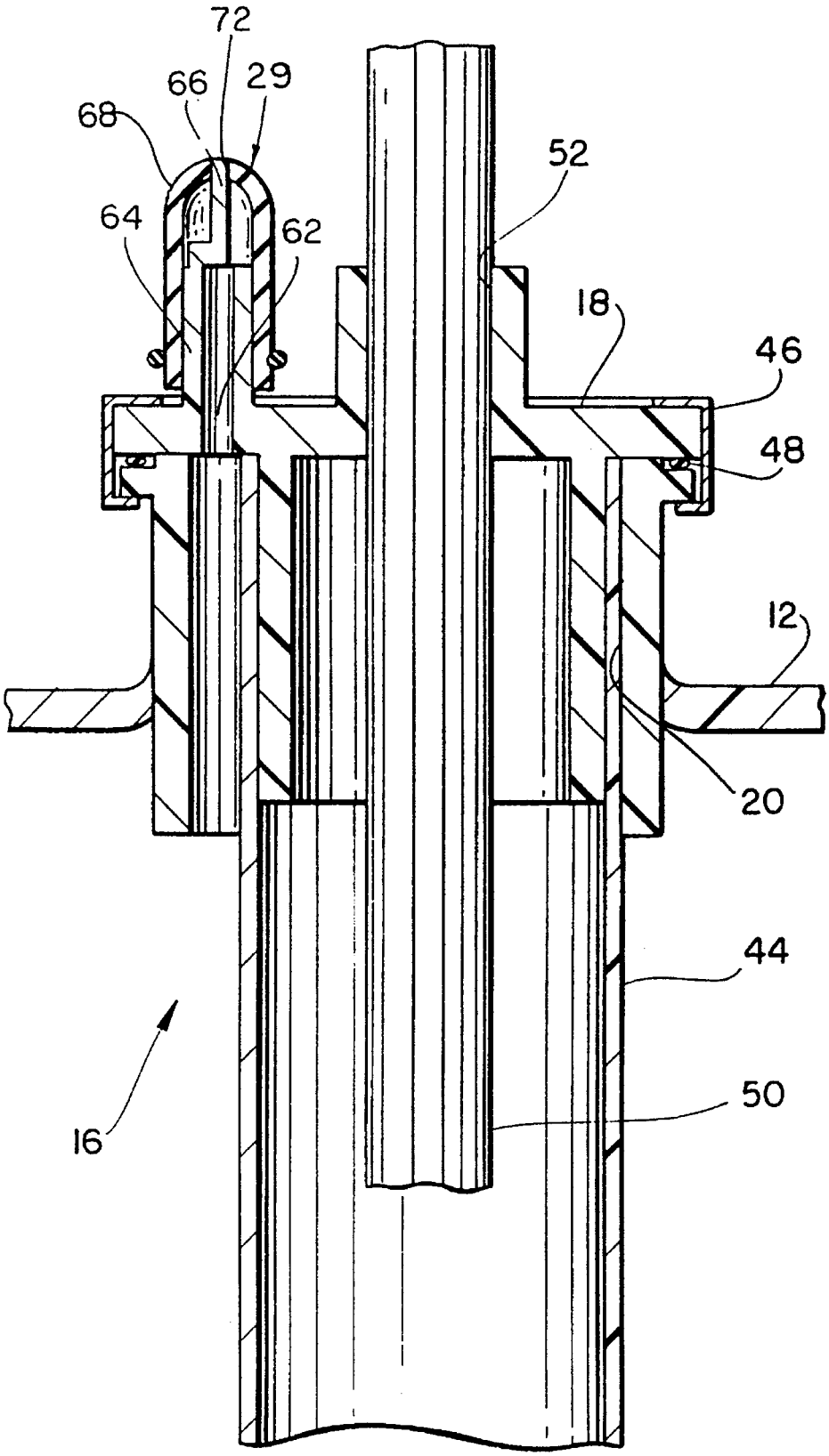
FIG. 6 is a sectional view still further enlarged showing the venting mechanism mounted with the upper end of the pump assembly.
Figure 7:
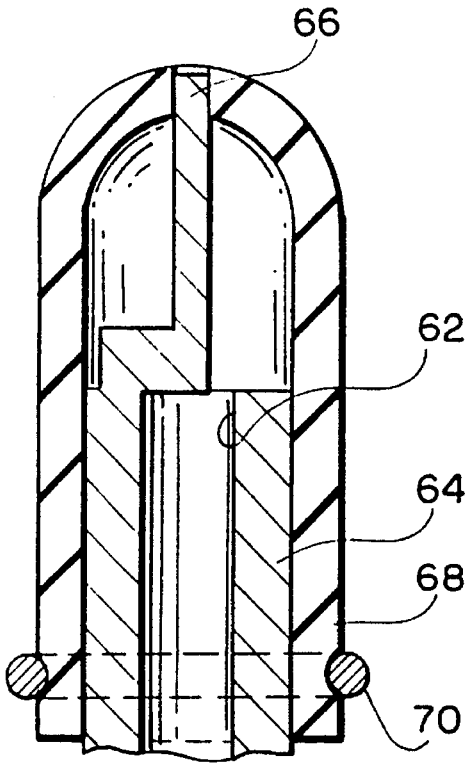
FIG. 7 is a further enlarged fragmentary sectional view of the vent mechanism.
Figure 8:
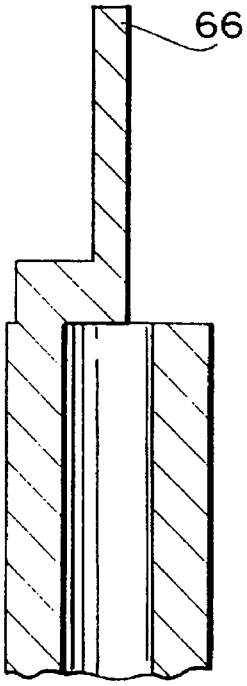
FIG. 8 is a similar enlarged sectional view of the boss of the vent mechanism.
Figure 9:
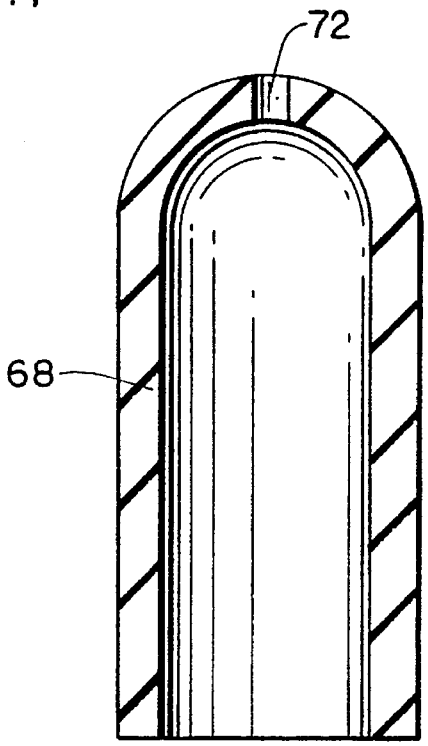
FIG. 9 is a similar enlarged sectional view of the sleeve of the vent mechanism.

In the drawing, the sprayer package 10 as supplied to the consumer is illustrated in FIGS. 1 and 2 as well as FIG. 5. In this condition the tank 12 of a suitable plastic is not pressurized but contains the diluted chemical solution to be sprayed and is also sealed so as to be a so called "shipper". Towards this end, the pump handle 14 will be suitably releasably secured in place for example, by tape, shrink wrap or any suitable releasable clip or fastener. The pump assembly 16 and, specifically, the top cap 18 on the pump cylinder will be suitably sealed and secured to the tank 12 across opening 20 but only after the tank 12 is filled. The externally mounted supply tube 22, threaded at its upper discharge or outlet end 24 will have an internally molded dome 26 for sealing the end 24 of the tube 22. In this regard, the tank 12, supply tube 22 and dome 26 may be integral and formed simultaneously by blow molding from a suitable resin. It is also contemplated that the supply tube can be internally mounted within the tank. Prior to use the integrally molded dome 26 is removed by severing, cutting or snipping along weakened zone 28. Furthermore, the vent assembly 29 will be sealed sufficiently to resist leakage particularly when the tank is not pressurized.

The hose 30 and spray control valve 32 may be conveniently sealably secured to the tank 12 along with the pump handle 14 or separately in any known fashion or by the shrink wrap label 34 extending circumferentially around the tank 12 within the circumferential recess 35. The label 34 also conveniently secures the extension rod 36 and discharge nozzle 38 within the longitudinal cavity 40. Although the extension rod 36 and nozzle 38 may initially be separate from the hose 30 and valve 32 it is preferred that these parts be unitary by having hose 30 extend from the proximal end all the way through the valve 32, rod 36 to the nozzle 38. Thus, the sprayer package 10 depicted in FIGS. 1 and 2 will be marketed and sold as shown with a contained chemical, preferably not under pressure, ready for spraying in the same fashion as and along with bottles of such solution or chemical concentrate.

Once the sprayer package 10 is purchased, the consumer prepares it for spraying by severing the integrally molded dome 26 along weakened zone 28. The proximal end of hose 30 is coupled with the externally threaded discharge or outlet end 24 of supply tubes 22 by threadably connecting internally threaded adapter 42 with this externally extended end 24. The pump assembly 16 is then activated to pressurize the interior of the tank 12 following which the contained chemical solution may be sprayed.

Referring now to pump assembly 16, it will be observed that pump cylinder 44 is suitably secured and sealed to the top cap 18. Cap 18 is, in turn, secured and sealed across opening 20 defined by raised surface of the tank 12 by the clamping member 46 and interposed O-ring 48. Obviously, other forms of attachment can be employed such as spin welding, gluing and the like. Piston rod 50 extends downwardly from the handle 14 and is slidable within bore 52 of the top cap 18. The lower end of rod 50 mounts piston 54 engaging the inner wall of the cylinder 44. The lower end of the cylinder 44 has secured thereto a plug 56 having aperture 58 covered by the umbrella valve 60. When the piston is pushed or depressed inwardly, the space in the cylinder 44 between the piston and plug is pressurized to force the umbrella valve 60 to flex and open aperture 58. In this manner the interior of the tank is pressurized to the desired extent as the piston is depressed and then retracted. Upon retraction of the piston 54, the valve 60 will close the aperture 58 to retain and trap the pressure within the tank 12.

In order to prevent over pressurization of the tank 12, vent assembly 29 is conveniently provided on the top cap 18. Towards that end, cap 18 includes a bore 62 communicating with the tank interior headspace and an upstanding boss 64 from which extends pin 66. An elastomeric sleeve 68 is retained on the boss 64 by retainer 70 and cooperates with pin 66 in forming a pin valve. The sleeve 68 includes a hole 72 accommodating the pin 66. This hole 72 is smaller than the pin 66 which will vent when the sleeve 68 is manually pinched or when pressure within the tank 12 is great enough to overcome the radial sealing force of the sleeve 68 on this pin 66. The opening of the pin valve is selected to occur at a predetermined pressure build up in the tank 12 so that dangerously high pressure within the tank 12 can not be generated.

The valve 32 is advantageously selected for its simplicity of structure and operation. Thus, valve 32 can simply be an IV type of valve in which the hose 30 extends with the flexible arm adapted to pivot from an outer position at which the bore of the hose 30 is opened to several intermediate inner positions at which the hose is squeezed to restrict the bore opening and eventually to a fully closed position at which the bore is completely shut.

Accordingly, this valve 32 may include a handle 74 through which the hose 30 extends. The rod 36 may be conveniently attached to the distal end of the handle as shown. Flexible arm 76 may be depressed from a fully extended position at which the hose 30 is not pinched to a depressed position at which the hose 30 is squeezed to decrease the size of the hose bore to restrict liquid flow to a fully depressed position at which the bore is closed. Obviously other types of flow control valves may be deployed.

As previously explained the hose 30 also extends within and through the rod 36 and is coupled in any suitable manner with nozzle 38 selected to provide the desired discharge pattern. Where desired or necessary a cone 78 may be associated with discharge nozzle 38.

In order to assure the dispensing of the entire contents of the tank 12, an angled handle 80 is integrally formed on the tank 12 and is so disposed and oriented such that when the handle 80 is held, the tank 12 will tip forwardly to place the base of the supply tube at the lowest most position relative to the remaining parts of the tank 12.

In order to keep the costs of the sprayer package 10 at a minimum, all parts are formed of a suitable resin.

It is contemplated that the sprayer of this invention can not be reused after the contents of the tank 12 has been emptied. In this regard, should the consumer attempt to remove the cap 18 and/or pump assembly 16, the cap 18 and surfaces defining tank opening 20 as well as the pump cylinder will be destroyed so that they can not be recoupled nor can they be rendered functional.

Figure 10:
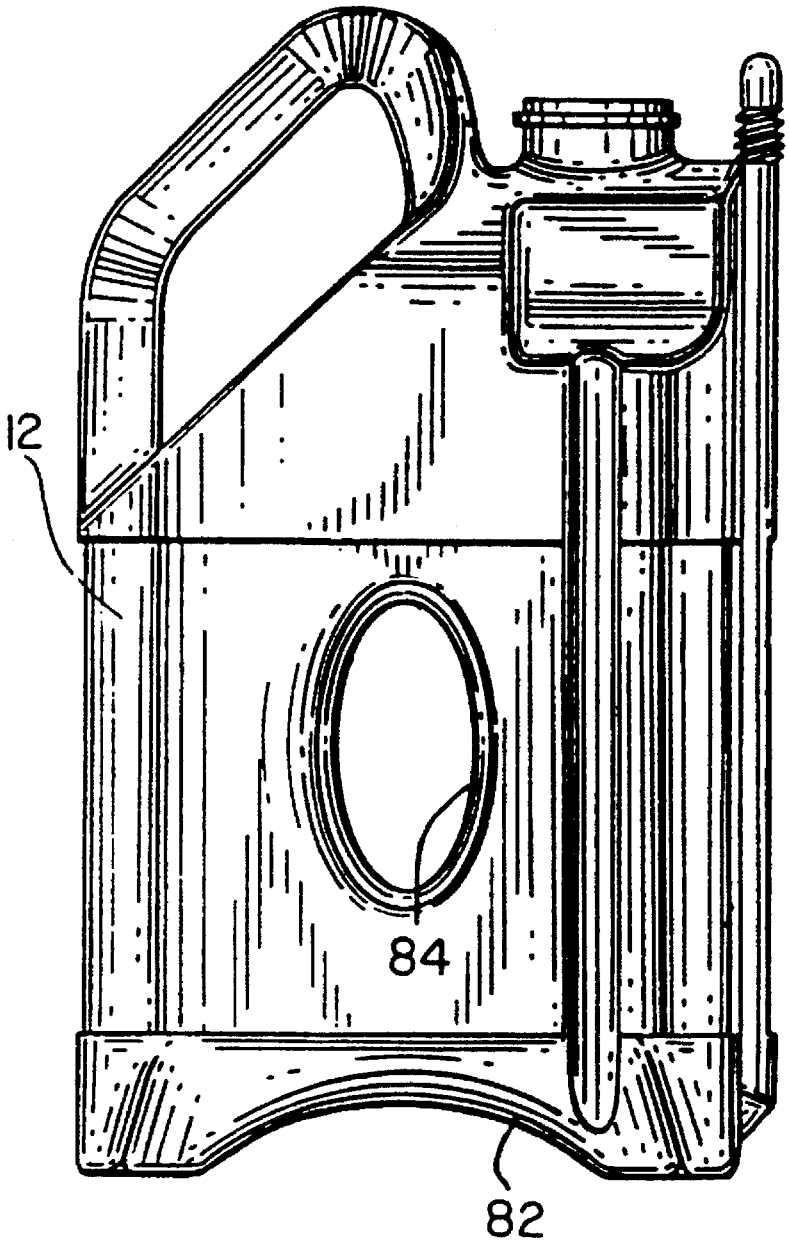
FIG. 10 is a modification of the tank contemplated by the present invention.

The present invention also contemplates strengthening tank 12 to ensure its integrity as inexpensively as possible. In this connection, the base is formed with a reverse dome 82 to prevent ballooning and cross member 84 (see FIG. 10) is blow molded into the tank to prevent bowing of the tank sides. The bowing of the sides and ballooning of the base occur as a result of the weight of the liquid and the pressure generated inside the tank 12

Thus, the several aforenoted objects and advantages are most effectively obtained. Although a single somewhat preferred embodiment has been disclosed and described in detail herein, it should be understood that this invention is in no sense limited thereby and its scope is to be determined by that of the appended claims.

We claim:

1. A one time use non reusable garden and industrial sprayer comprising:

a vertically upright plastic tank having an exterior and an interior for liquid to be dispensed under pressure, the tank having an inlet for filling the tank with the liquid and an outlet for the liquid contained in the tank and having a base adapted to rest on a horizontal surface whereby the tank is in an upright vertical position;

pump means for forcing the liquid out the outlet under pressure, the pump means including a cylinder and piston movable in the cylinder, the cylinder being disposed in the tank and having an outer end, the tank having surfaces proximal the cylinder outer end;

destructible connecting means for connecting the cylinder upper end to the proximal surfaces of the tank and being so constructed and arranged to destroy at least one of the cylinder upper end, the proximal surfaces of the tank and the connecting means so that the sprayer can not be reused;

a hose having a proximal end extending from the tank outlet and having a distal end;

a vertical supply tube having a lower end communicating with the tank interior and an upper end coupled with the hose;

a control valve associated with the hose for controlling the amount of discharge of the liquid that is sprayed, the control valve including a handle having a passageway, the hose extending through the passageway of the handle, a movable arm on the handle adapted to be moved away from the hose and towards the hose to pinch the hose and restrict the flow of liquid therein;

a discharge nozzle coupled with the distal end of the hose for the selected discharge pattern of the liquid to be sprayed; and venting means for preventing over pressurization of the tank interior.

2. The invention in accordance with claim 1 wherein, the supply tube is external and integrally blow molded with the tank and being on the exterior thereof.

3. The invention in accordance with claim 1 where an angled handle extends upwardly and integrally from the tank and is so constructed and arranged so that when gripped, the tank will tilt from its vertical upright position to permit all of the liquid in the tank to be removed by spraying the angled handle having a gripping part disposed at an angle less than 90° relative to the supply tube.

4. The invention in accordance with claim 1 wherein a longitudinal vertically extending cavity is formed on the side surface of the exterior of the tank, an extension rod is coupled with the discharge nozzle and the rod being disposed in the cavity and secured therein prior to purchase and use thereof by a customer.

5. The invention in accordance with claim 1, a reverse dome is integrally molded in the base for strengthening the base and prevent ballooning thereof.

6. The invention in accordance with claim 1 wherein the exterior of the tank is slightly recessed over a part of the end and side surfaces about its circumference to receive a shrink wrapped label.

7. The invention in accordance with claim 1 wherein the tank has side walls defining the side surfaces and a through hole is integrally molded in the tank to join the side walls and prevent bowing thereof.

8. The invention in accordance with claim 1 wherein the tank inlet is defined by raised surfaces of the tank defining an opening, the cylinder outer end being connected with the raised surfaces, the destructible means include a cap extending over the cylinder outer end and tank inlet and being connected to both the cylinder outer end and the raised surfaces of the tank.

9. The invention in accordance with claim 1 wherein the cylinder of the pump means has an interior surface and an inner end, a plug at the cylinder inner end and having a plurality of openings, an umbrella valve extending over and closing the openings and adapted to flex to open the openings, the piston having a piston rod having an outer end extending exteriorly of the tank and a handle on the outer end of the piston rod, the piston engaging the interior surfaces of the cylinder and adapted to be retracted by pulling on the handle and depressed by pushing the handle, when the piston is depressed the space between the piston and plug is pressurized to flex the umbrella valve and open the openings to pressurize the interior of the tank, and when the piston is retracted the umbrella valve closes the openings to trap the pressure in the tank interior, the pulling and pushing of the handle is repeated until the tank interior is pressured to the desired extent for spraying.

10. The invention in accordance with claim 1 wherein the venting means including a pin valve that is adapted to be opened manually by squeezing and automatically opens when the pressure within the tank reaches a predetermined level.

11. The invention in accordance with claim 1 wherein an extension rod is connected to the handle and extends around the hose and is coupled with the discharge nozzle.

12. A one time use non reusable sprayer comprising:

a plastic tank having an exterior and an interior for liquid to be dispensed under pressure, the tank having an inlet for filling the tank with the liquid and an outlet for the liquid contained in the tank;

pump means for forcing the liquid out the outlet under pressure, the pump means including a cylinder and piston movable in the cylinder, the cylinder being disposed in the tank and having an outer end, the tank having surfaces proximal the cylinder outer end;

destructible connecting means for connecting the cylinder upper end to the proximal surfaces of the tank and being so constructed and arranged to destroy at least one of the cylinder upper end, the proximal surfaces of the tank and the connecting means so that the sprayer can not be reused;

a hose having a proximal end extending from the tank outlet and having a distal end;

a control valve associated with the hose for controlling the amount of discharge of the liquid that is sprayed;

a discharge nozzle coupled with the distal end of the hose for the selected discharge pattern of the liquid to be sprayed;

venting means for preventing over pressurization of the tank interior;

the venting means including a pin valve that is adapted to be opened manually by squeezing and automatically opens when the pressure within the tank reaches a predetermined level; and the tank inlet being defined by raised surfaces of the tank defining an opening, the cylinder outer end being connected with the raised surfaces, the destructible means includes a cap extending over the cylinder outer end and tank inlet and being connected to both the cylinder outer end and the raised surfaces of the tank, a bore in the cap, the pin valve including a boss having the bore and an upwardly projecting pin, a resilient sleeve secured about the boss and having an opening the surface of the sleeve opening tightly embraces the pin.

13. A one time use non reusable sprayer comprising:

a plastic tank having an exterior and an interior for liquid to be dispensed under pressure, the tank having an inlet for filling the tank with the liquid and an outlet for the liquid contained in the tank;

pump means for forcing the liquid out the outlet under pressure, the pump means including a cylinder and piston movable in the cylinder, the cylinder being disposed in the tank and having an outer end, the tank having surfaces proximal the cylinder outer end;

destructible connecting means for connecting the cylinder upper end to the proximal surfaces of the tank and being so constructed and arranged to destroy at least one of the cylinder upper end, the proximal surfaces of the tank and the connecting means so that the sprayer can not be reused;

a hose having a proximal end extending from the tank outlet and having a distal end;

a control valve associated with the hose for controlling the amount of discharge of the liquid that is sprayed;

a discharge nozzle coupled with the distal end of the hose for the selected discharge pattern of the liquid to be sprayed;

venting means for preventing over pressurization of the tank interior;

an external supply tube being integrally blow molded with the tank and being on the exterior thereof, the tube having a lower end communicating with the tank interior and an upper end coupled with the hose;

an angled handle extending upwardly and integrally from the tank and is so constructed and arranged so that when gripped, the tank will tilt to permit all of the liquid in the tank to be removed by spraying;

a longitudinal cavity being formed on the exterior of the tank, an extension rod is coupled with the discharge nozzle and the rod being disposed in the cavity and secured therein prior to purchase and use thereof by a customer;

the tank having a base, a reverse dome integrally molded in the base for strengthening the base and prevent ballooning thereof, the exterior of the tank is slightly recessed about its circumference to receive a shrink wrapped label cooperating in securing the rod in the cavity, the tank having side walls and a through hole is integrally molded in the tank to join the side walls and prevent bowing thereof;

the cylinder of the pump means having an interior surface and an inner end, a plug at the cylinder inner end and having a plurality of openings, an umbrella valve extending over and closing the openings and adapted to flex to open the openings, the piston having a piston rod having an outer end extending exteriorly of the tank and a handle on the outer end of the piston rod, the piston engaging the interior surfaces of the cylinder and adapted to be retracted by pulling on the handle and depressed by pushing the handle, when the piston is depressed the space between the piston and plug is pressurized to flex the umbrella valve and open the openings to pressurize the interior of the tank, and when the piston is retracted the umbrella valve closes the openings to trap the pressure in the tank interior, the pulling and pushing of the handle is repeated until the tank interior is pressured to the desired extent for spraying;

the venting means including a pin valve that is adapted to be opened manually by squeezing and automatically opens when the pressure within the container reaches a predetermined level;

the tank inlet being defined by raised surfaces of the tank defining an opening, the cylinder outer end being connected with the raised surfaces, the destructible means including a cap extending over the cylinder outer end and tank inlet and being connected to both the cylinder outer end and the raised surfaces of the tank, a bore in the cap, the pin valve including a boss having the bore and an upwardly projecting pin, a resilient sleeve secured about the boss and having an opening the surface of which tightly embrace the pin;

the control valve including a handle having a passageway, the hose extending through the passageway of the handle, a pivotal arm on the handle adapted to be pivoted away from the hose and towards the hose to pinch the hose and restrict the flow of liquid therein; and the extension rod being connected to the handle and extending around the hose.

* * * * *